US006885136B2

(12) United States Patent
Orjela et al.

(10) Patent No.: US 6,885,136 B2
(45) Date of Patent: Apr. 26, 2005

(54) IGNITION DEVICE HAVING AN ELECTRODE FORMED FROM AN IRIDIUM-BASED ALLOY

(76) Inventors: Gurdev Orjela, 56, Rue De L'eau, Autelbas Barnich (BE), 6700; Paul Tinwell, 23 St. Catherines Drive, Hartford, Northwich, Cheshire (GB), CW8 2FE; Robin Hyde, 5 Wilbury Close, Letchworth Hertfordshire (GB), SG6 4JX; Duncan Roy Coupland, 68 Warren Wood Drive, High Wycombe (GB), HP11 1EA ( * ) Notice: Subject to any disclaimer, the term of this patent is extended or adjusted under 35 U.S.C. 154(b) by 0 days.

(21) Appl. No.: 10/390,075

(22) Filed: Mar. 17, 2003

(65) Prior Publication Data

US 2004/0183418 A1 Sep. 23, 2004

(30) Foreign Application Priority Data

Jul. 13, 2002 (GB) ..... 0216323

(51) Int. Cl.[7] ..... H01T 13/20
(52) U.S. Cl. ..... 313/141; 313/142; 313/143
(58) Field of Search ..... 313/118, 141, 313/142, 143, 144, 145

(56) References Cited

U.S. PATENT DOCUMENTS

| | | | | |
|---|---|---|---|---|
| 3,262,779 A | | 7/1966 | Price et al. | |
| 3,293,031 A | | 12/1966 | Rhys et al. | |
| 3,970,450 A | | 7/1976 | Liu et al. | |
| 4,324,588 A | | 4/1982 | Zysk et al. | |
| 4,659,960 A | * | 4/1987 | Toya et al. | 313/141 |
| 4,743,793 A | * | 5/1988 | Toya et al. | 313/141 |
| 5,793,793 A | | 8/1998 | Matsutani et al. | |
| 5,853,904 A | | 12/1998 | Hall et al. | |
| 5,998,913 A | * | 12/1999 | Matsutani | 313/141 |
| 6,071,163 A | | 6/2000 | Chang et al. | |
| 6,094,000 A | | 7/2000 | Osamura et al. | |
| 6,121,719 A | * | 9/2000 | Matsutani et al. | 313/141 |
| 6,147,441 A | | 11/2000 | Osamura | |
| 6,166,479 A | * | 12/2000 | Matsutani et al. | 313/141 |
| 6,215,235 B1 | | 4/2001 | Osamura | |
| 6,262,522 B1 | | 7/2001 | Osamura | |
| 6,304,022 B1 | * | 10/2001 | Matsutani | 313/141 |
| 6,326,720 B1 | * | 12/2001 | Ito et al. | 313/141 |
| 6,664,719 B2 | * | 12/2003 | Matsutani et al. | 313/141 |

FOREIGN PATENT DOCUMENTS

EP 1286442 A1 2/2003

* cited by examiner

*Primary Examiner*—Joseph Williams
*Assistant Examiner*—Kevin Quarterman
(74) *Attorney, Agent, or Firm*—Reising, Ethington, Barnes, Kisselle, P.C.

(57) ABSTRACT

An ignition device such as a spark plug having ground and center electrodes, at least one of which includes a firing tip formed from an alloy containing iridium, rhodium, tungsten, and zirconium. With the inclusion of tungsten and zirconium in the alloy, the percentage of rhodium can be kept relatively low without sacrificing the erosion resistance or reduced sparking voltage of the firing tip. In one embodiment, the firing tip contains 2.5% rhodium, 0.3% tungsten, 0.07% zirconium, and the balance iridium.

16 Claims, 1 Drawing Sheet

IGNITION DEVICE HAVING AN ELECTRODE FORMED FROM AN IRIDIUM-BASED ALLOY

TECHNICAL FIELD

This invention relates generally to spark plugs and other ignition devices used in internal combustion engines and, more particularly, to such ignition devices having noble metal firing tips. As used herein, the term "ignition device" means spark plugs, igniters, and other such devices that are used to initiate the combustion of a gas or fuel.

BACKGROUND OF THE INVENTION

A variety of iridium-based alloys have been proposed for use in spark plug electrodes to increase the erosion resistance of the firing surfaces of the electrodes. Iridium has a relatively high melting point and is more resistant to spark erosion than many of the metals widely used today. The iridium is typically used in the form of a pad or rivet that is laser welded or otherwise metallurgically bonded to the center and ground electrodes on either side of the spark gap. There are, however, known disadvantages to the use of iridium, including difficulty in bonding of the iridium to the electrodes and oxidative volatilization of the iridium at higher temperatures. The present invention addresses the latter of these two problems.

A known approach for reducing the oxidative loss of iridium is to utilize it in the form of an alloy combined with rhodium. U.S. Pat. No. 6,094,000 and published UK patent application GB 2,302,367 to Osamura et al. discloses such an alloy in which rhodium can be included in an amount ranging from 1–60 wt %. Group 3A and 4A elements such as yttria or zirconium oxide can also be added to help reduce consumption resistance. Notwithstanding Osamura et al.'s teaching of use of rhodium in amounts as low as 1%, it has been found that minimization of oxidative loss of the iridium at higher temperatures requires much higher amounts of rhodium. This is borne out in the test data presented by Osamura et al. and their patent notes that the amount of rhodium is preferably at least 3%.

U.S. Pat. No. 5,793,793 to Matsutani et al. reports a similar finding, wherein the amount of rhodium is kept within the range of 3–50 wt % and, most preferably, is at least 18%. In U.S. Pat. No. 5,998,913, Matsutani identifies some disadvantages of the inclusion of high percentages of rhodium and, in an effort to reduce the amount of rhodium in the alloy, proposes the addition of rhenium or ruthenium. According to this patent, by adding rhenium and/or ruthenium in amounts up to 17 wt %, the amount of rhodium needed to maintain good resistance to oxidative consumption can be lowered to as little as 0.1 wt %.

SUMMARY OF THE INVENTION

The present invention is directed to an ignition device having a pair of electrodes defining a spark gap therebetween, with at least one of the electrodes including a firing tip formed from an alloy of iridium, rhodium, tungsten, and zirconium. The combination of these constituent elements permits the known benefits of good erosion resistance and lowered sparking voltages to be obtained at much lower percentages of rhodium than has been found desirable in alloys containing only iridium and rhodium.

BRIEF DESCRIPTION OF THE DRAWINGS

A preferred exemplary embodiment of the present invention will hereinafter be described in conjunction with the appended drawings, wherein like designations denote like elements, and.

DESCRIPTION OF THE PREFERRED EMBODIMENTS

Figure 1:
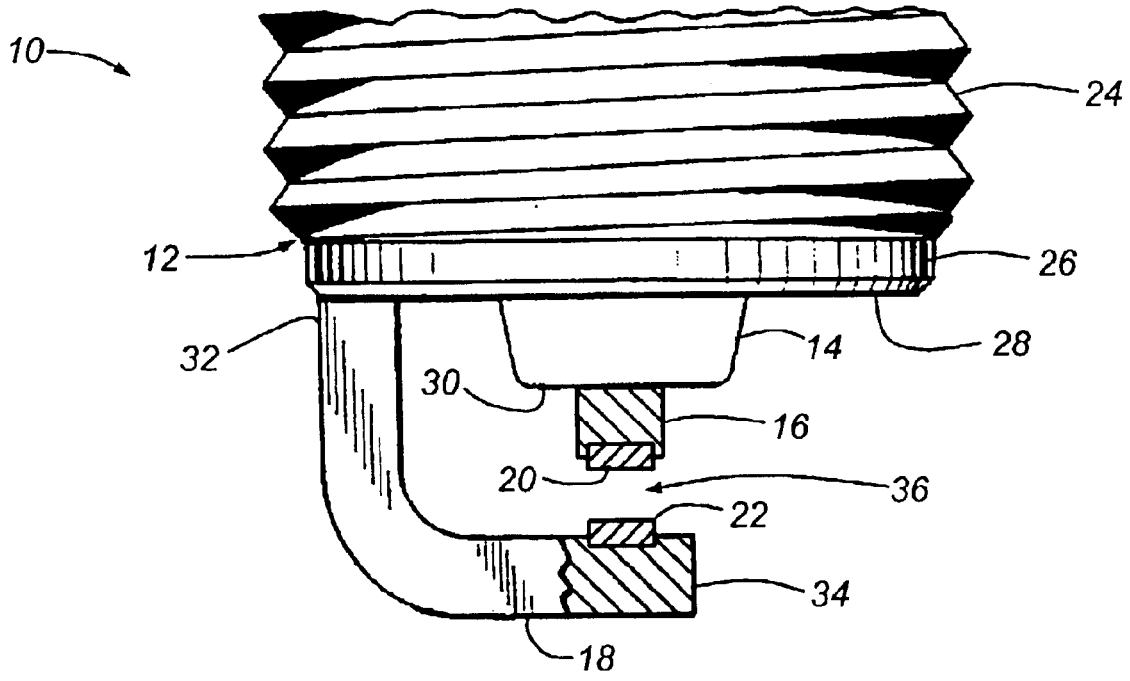
FIG. 1 is a fragmentary view and a partially cross-sectional view of a spark plug constructed in accordance with a preferred embodiment of the invention.

Referring to FIG. 1, there is shown the working end of a spark plug 10 that includes a metal casing or housing 12, an insulator 14 secured within the housing, a center electrode 16, a ground electrode 18, and a pair of firing tips 20, 22 located opposite each other on the center and ground electrodes 16, 18, respectively. Housing 12 can be constructed in a conventional manner and can include standard threads 24 along with an annular lower end 26 to which the ground electrode 18 is welded or otherwise attached. Similarly, all other components of the spark plug 10 (including those not shown) can be constructed using known techniques and materials, excepting of course the ground and/or center electrodes 16, 18 which are constructed with firing tip 20 and/or 22, as will be described below.

As is known, the annular end 26 of housing 12 defines an opening 28 through which insulator 14 protrudes. Center electrode 16 is permanently mounted within insulator 14 by a glass seal or using any other suitable technique. It extends out of insulator 14 through an exposed, axial end 30. Ground electrode 18 is in the form of a conventional ninety-degree elbow that is mechanically and electrically attached to housing 12 at one end 32 and that terminates opposite center electrode 16 at its other end 34. This free end 34 comprises a firing end of the ground electrode 18 that, along with the corresponding firing end of center electrode 16, defines a spark gap 36 therebetween.

The firing tips 20, 22 are each located at the firing ends of their respective electrodes 16, 18 so that they provide sparking surfaces for the emission and reception of electrons across the spark gap 36. These firing ends are shown in cross-section for purposes of illustrating the firing tips which, in this embodiment, comprise pads welded into place on the firing ends. As shown, the firing tips 20, 22 can be welded into partial recesses on each electrode. Optionally, one or both of the pads can be fully recessed on its associated electrode or can be welded onto an outer surface of the electrode without being recessed at all.

In accordance with the invention, each firing tip is formed from an alloy containing iridium, rhodium, tungsten, and zirconium. Preferably, the alloy is formed from a combination of iridium with 1–3 wt % rhodium, 0.1–0.5 wt % tungsten, and 0.05–0.1 wt % zirconium with no more than minor amounts of anything else. "Minor amounts," means a combined maximum of 2000 ppm of unspecified base metal and PGM (platinum group metals) impurities. In a highly preferred embodiment, the alloy is formed from about 2.5 wt % rhodium, about 0.3 wt % tungsten, about 0.07 wt % zirconium, and the balance iridium with no more than trace amounts of anything else. The alloy can be formed by known processes such as by melting the desired amounts of iridium, rhodium, tungsten, and zirconium together. After melting, the alloy can be converted into a powdered form by an atomization process, as is known to those skilled in the art. The powdered alloy can then be isostatically pressed into solid form, with secondary shaping operations being used if necessary to achieve the desired final form. Techniques and procedures for accomplishing these steps are known to those skilled in the art.

Although the electrodes can be made directly from the alloy, preferably they are separately formed from a more conventional electrically-conductive material, with the alloy being formed into firing tips for subsequent attachment to the electrodes. Once both the firing tips and electrodes are formed, the firing tips are then permanently attached, both mechanically and electrically, to their associated electrodes by metallurgical bonding, such as laser welding, laser joining, or other suitable means. This results in the electrodes each having an integral firing tip that provides an exposed sparking surface for the electrode. Laser welding can be done according to any of a number of techniques well known to those skilled in the art. Laser joining involves forming a mechanical interlock of the electrode to the firing tip by using laser light to melt the electrode material so that it can flow into a recess or other surface feature of the firing tip, with the electrode thereafter being allowed to solidify and lock the firing tip in place. This laser joining technique is more fully described in European Patent Office publication no. EP 1 286 442 A1, the complete disclosure of which is hereby incorporated by reference.

Figure 2:
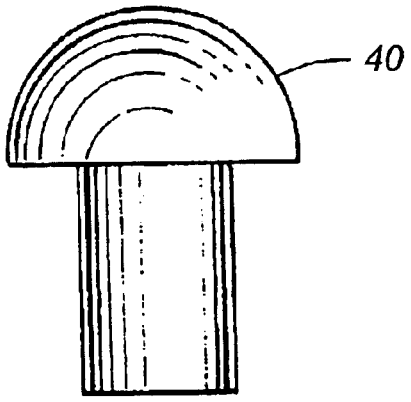
FIG. 2 is a side view of a rivet that can be used in place of the firing tip pads used on the spark plug of FIG. 1.
Figure 3:
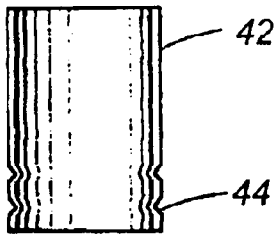
FIG. 3 depicts a wire that can be used in place of the firing tip pads shown in FIG. 1.

As will be appreciated, the firing tips 20, 22 need not be pads, but can take the form of a rivet 40 (shown in FIG. 2), a wire 42 (shown in FIG. 3), a ball (not shown), or any other suitable shape. Although a round-end rivet is shown in FIG. 2, a rivet having a conical or frusto-conical head could also be used. As indicated in FIG. 3, the firing tip can, but need not, include one or more surface features such as grooves 44 to permit it to be interlocked to the electrode using the laser joining technique discussed above. The construction and mounting of these various types of firing tips is known to those skilled in the art. Also, although the firing ends of both the center and ground electrodes are shown having a firing tip formed from the iridium/rhodium/tungsten/zirconium alloy, it will be appreciated that the alloy could be used on only one of the electrodes. The other electrode can be utilized without any firing tip or can include a firing tip formed from another precious metal or precious metal alloy. For example, in one embodiment, the center electrode firing tip 20 can be formed from the iridium/rhodium/tungsten/zirconium alloy and the ground electrode firing tip 20 can be formed from platinum or a platinum alloy.

The combination of iridium, rhodium, tungsten, and zirconium has been found to yield an alloy the exhibits good resistance to both spark and oxidative consumption, and the present invention permits these benefits to be maintained using relatively small amounts of rhodium.

It will thus be apparent that there has been provided in accordance with the present invention an ignition device and manufacturing method therefor which achieves the aims and advantages specified herein. It will, of course, be understood that the foregoing description is of preferred exemplary embodiments of the invention and that the invention is not limited to the specific embodiments shown. Various changes and modifications will become apparent to those skilled in the art. For example, although an ignition device in the form of a spark plug has been illustrated, it will be appreciated that the invention can be incorporated into an igniter of the type in which sparking occurs across the surface of a semiconducting material disposed between the center electrode and an annular ground electrode. All such changes and modifications are intended to be within the scope of the present invention.

What is claimed is:

1. An ignition device for an internal combustion engine, comprising:

a housing;

an insulator secured within said housing and having an exposed axial end at an opening in said housing;

a center electrode mounted in said insulator and extending out of said insulator through said axial end; and a ground electrode mounted on said housing and terminating at a firing end located opposite said center electrode to define a spark gap therebetween;

characterized in that at least one of said electrodes includes a firing tip formed from an alloy containing iridium, rhodium, tungsten, and zirconium.

2. An ignition device as defined in claim 1, wherein said alloy is formed from a combination of iridium with 1–3 wt % rhodium, 0.1–0.5 wt % tungsten, and 0.05–0.1 wt % zirconium.

3. An ignition device as defined in claim 1, wherein said alloy is formed from a combination of iridium with about 2.5 wt % rhodium, about 0.3 wt % tungsten, and about 0.07 wt % zirconium.

4. An ignition device as defined in claim 1, wherein said firing tip is metallurgically bonded to said center electrode at said spark gap.

5. An ignition device as defined in claim 4, wherein said firing tip comprises a section of wire laser joined to said center electrode.

6. An ignition device as defined in claim 4, wherein said firing end of said ground electrode includes a firing tip located opposite the firing tip of said center electrode.

7. An ignition device as defined in claim 6, wherein said firing tip on said ground electrode comprises platinum or a platinum alloy.

8. An ignition device as defined in claim 7, wherein said firing tip on said center electrode is formed from a combination of iridium with 1–3 wt % rhodium, 0.1–0.5 wt % tungsten, and 0.05–0.1 wt % zirconium.

9. An ignition device as defined in claim 7, wherein said firing tip on said center electrode is formed from a combination of iridium with about 2.5 wt % rhodium, about 0.3 wt % tungsten, and about 0.07 wt % zirconium.

10. An ignition device as defined in claim 1, wherein said ignition device comprises a spark plug.

11. An ignition device as defined in claim 1, wherein said firing tip consists essentially of iridium, rhodium, tungsten, and zirconium.

12. An ignition device as defined in claim 11, wherein both said electrodes include a firing tip consisting essentially of iridium, rhodium, tungsten, and zirconium.

13. An ignition device as defined in claim 11, wherein said firing tip is made from an alloy that is formed from a combination of iridium with 1–3 wt % rhodium, 0.1–0.5 wt % tungsten, and 0.05–0.1 wt % zirconium.

14. An ignition device as defined in claim 11, wherein said firing tip is made from alloy that is formed from a combination of iridium with about 2.5 wt % rhodium, about 0.3 wt % tungsten, and about 0.07 wt % zirconium.

15. An ignition device for an internal combustion engine, comprising:

a housing;

an insulator secured within said housing and having an exposed axial end at an opening in said housing;

a center electrode mounted in said insulator and extending out of said insulator through said axial end; and a ground electrode mounted on said housing and terminating at a firing end located opposite said center electrode to define a spark gap therebetween;

characterized in that at least one of said electrodes includes a firing tip formed from an alloy containing iridium, 1–3 wt % rhodium, 0.1–0.5 wt % tungsten, and 0.05–0.1 wt % zirconium.

16. An ignition device for an internal combustion engine, comprising:

a housing;

an insulator secured within said housing and having an exposed axial end at an opening in said housing;

a center electrode mounted in said insulator and extending out of said insulator through said axial end; and a ground electrode mounted on said housing and terminating at a firing end located opposite said center electrode to define a spark gap therebetween;

characterized in that at least one of said electrodes includes a firing tip formed from an alloy containing a combination of iridium with about 2.5 wt % rhodium, about 0.3 wt % tungsten, and about 0.07 wt % zirconium.

* * * * *